US008890425B2

(12) United States Patent
Zeng

(10) Patent No.: US 8,890,425 B2
(45) Date of Patent: Nov. 18, 2014

(54) BLEND DIMMING CIRCUITS AND RELEVANT METHODS

(71) Applicant: Silergy Semiconductor Technology (Hangzhou) Ltd, Hangzhou (CN)

(72) Inventor: Qingqing Zeng, Hangzhou (CN)

(73) Assignee: Silergy Semiconductor Technology (Hangzhou) Ltd, Hangzhou (CN)

( * ) Notice: Subject to any disclaimer, the term of this patent is extended or adjusted under 35 U.S.C. 154(b) by 116 days.

(21) Appl. No.: 13/761,566

(22) Filed: Feb. 7, 2013

(65) Prior Publication Data

US 2013/0234612 A1 Sep. 12, 2013

(30) Foreign Application Priority Data

Mar. 9, 2012 (CN) ..... 2012 1 0060442

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 37/02*** | (2006.01) |
| ***H05B 33/08*** | (2006.01) |

(52) U.S. Cl.

CPC ..... *H05B 37/02* (2013.01); *H05B 33/0848* (2013.01)

USPC ..... 315/200 R; 315/171

(58) Field of Classification Search

CPC .... H05B 41/34; H05B 33/0803; H05B 39/09; H05B 41/18; B23H 1/022

USPC ..... 315/200 R, 171, 189; 323/227, 291; 363/74

See application file for complete search history.

(56) References Cited

U.S. PATENT DOCUMENTS

| | | | | |
|---|---|---|---|---|
| 8,558,477 | B2 * | 10/2013 | Bordin et al. | 315/287 |
| 8,558,518 | B2 * | 10/2013 | Irissou et al. | 323/237 |
| 2011/0074302 | A1 * | 3/2011 | Draper et al. | 315/224 |
| 2011/0266967 | A1 * | 11/2011 | Bordin et al. | 315/287 |
| 2014/0176016 | A1 * | 6/2014 | Li et al. | 315/307 |

* cited by examiner

*Primary Examiner* — Dylan White
(74) *Attorney, Agent, or Firm* — Michael C. Stephens, Jr.

(57) ABSTRACT

The present disclosure relates to blend dimming circuits and methods for driving light loads. In one embodiment, a method can include: converting an external sinusoidal AC power supply to a phase-missing DC voltage signal; detecting a conduction angle of the phase-missing DC voltage signal to generate a first control signal representing the conduction angle; generating an analog dimming signal based on the first control signal; generating, by a PWM dimming circuit, a PWM dimming signal based on the analog dimming signal and a light load feedback signal; regulating light load brightness by PWM dimming when the conduction angle is greater than a threshold angle; regulating the light load brightness by PWM and analog dimming when the conduction angle is less than the threshold angle; and enabling a power stage circuit when the first control signal is active to regulate the brightness of the light load.

9 Claims, 9 Drawing Sheets

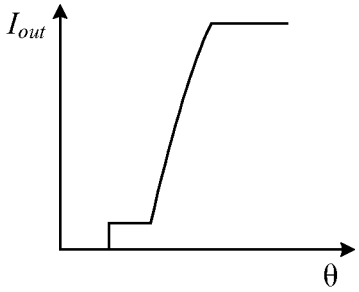
FIG. 1 (conventional)

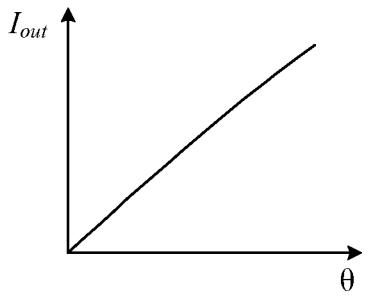
FIG. 2 (conventional)

BLEND DIMMING CIRCUITS AND RELEVANT METHODS

RELATED APPLICATIONS

This application claims the benefit of Chinese Patent Application No. 201210060442.6, filed on Mar. 9, 2012, which is incorporated herein by reference in its entirety.

FIELD OF THE INVENTION

The present invention relates to dimming circuits for driving light loads, and more specifically to blend dimming circuits, and associated methods.

BACKGROUND

Light-emitting diode (LED) is not only a solid-state electronic light source, but also a semiconductor lighting device. Advantages of LED-based lighting include relatively small volume products, relatively high mechanical strength, relatively low power losses, relatively long lifetime, and improved environmental friendliness. In addition, LED is relatively easy to be regulated and controlled. Therefore, LED is a light source with a exciting developmental prospects. Also, LED dimming methods can include analog dimming and digital dimming.

SUMMARY

In one embodiment, a blend dimming method for driving a light load can include: (i) converting an external sinusoidal AC power supply to a phase-missing DC voltage signal; (ii) detecting a conduction angle of the phase-missing DC voltage signal to generate a first control signal that represents the conduction angle; (iii) generating an analog dimming signal based on the first control signal; (iv) generating, by a pulse-width modulation (PWM) dimming circuit, a PWM dimming signal based on the analog dimming signal and an output feedback signal of the light load; (v) regulating a brightness of the light load by PWM dimming when the conduction angle is greater than a threshold angle; (vi) regulating the brightness of the light load by the PWM dimming and analog dimming when the conduction angle is less than the threshold angle; and (vii) enabling said PWM dimming circuit to control a power stage circuit to regulate said brightness of said light load when said first control signal is active.

In one embodiment, a blend dimming circuit can include: (i) a conduction angle detector configured to receive a phase-missing DC voltage signal, and to generate a first control signal that represents a conduction angle of the phase-missing DC voltage signal; (ii) an analog dimming circuit coupled to the conduction angle detector, where the analog dimming circuit is configured to receive the first control signal, and to generate therefrom an analog dimming signal, where the analog dimming signal comprises a predetermined fixed value when the conduction angle is greater than a threshold angle, and where the analog dimming signal comprises a variable value when the conduction angle is less than the threshold angle; and (iii) a PWM dimming circuit coupled to the analog dimming circuit, where the PWM dimming circuit is configured to receive the analog dimming signal, and to generate therefrom a PWM control signal, where the PWM dimming circuit is enabled to regulate a brightness of a light load when the first control signal is active.

Embodiments of the present invention can advantageously provide several advantages over conventional approaches.

For example, particular embodiments can provide blend dimming circuits and methods based on a PWM dimming mode. In addition, an analog dimming approach can be included to optimize a dimming curve to reduce a rapid increase of an LED load output current in order to avoid increasing input current during the PWM dimming mode. Other advantages of the present invention may become readily apparent from the detailed description of preferred embodiments below.

BRIEF DESCRIPTION OF THE DRAWINGS

FIG. 1 is a dimming curve diagram of an example analog dimming circuit.

FIG. 2 is a dimming curve diagram of an example PWM dimming circuit.

DETAILED DESCRIPTION

Figure 3:
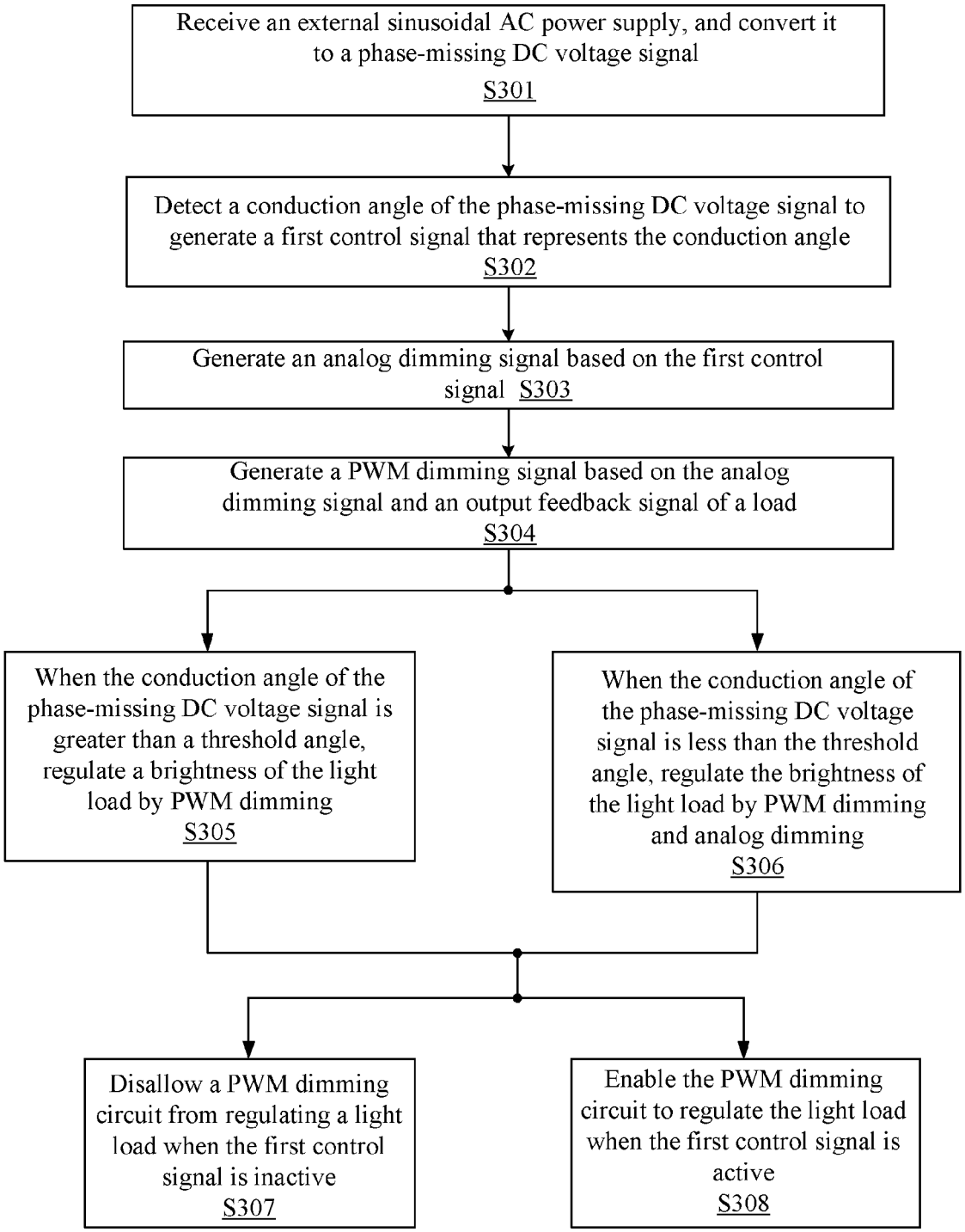
FIG. 3 is a flow diagram of an example blend dimming method in accordance with embodiments of the present invention.

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Particular embodiments can provide blend dimming circuits and methods based on a pulse-width modulation (PWM) dimming mode. In addition, an analog dimming approach can be included to optimize a dimming curve to reduce a rapid increase of a light-emitting diode (LED) load output current in order to avoid increasing input current during the PWM dimming mode.

Analog dimming can regulate the brightness of an LED by changing the current value in the LED loop. However, as shown in the dimming curve of analog dimming circuit of FIG. 1, an analog dimming range may be limited in the range of when current is adjustable (not constant). When the conduction angle θ of triode for an alternating current (triac)

rectifier element is decreasing, output current $I_{out}$ may be significantly decreased, and as a result the corresponding input current may be decreased when the conduction angle is relatively small.

Also, if the power is relatively low, the triac may turn off in advance to effect a conduction time of the next period. As a result, the output current may change abruptly to yield flickering LED lights at the load. At the same time, since comparators may utilize in analog dimming, a relatively small dimming proportion may not be achieved due to self-hysteresis characteristics of the comparators.

Digital dimming (e.g., PWM dimming) can change the turn on time of an LED to any time by regulating the PWM duty cycle to enlarge the dimming range. In PWM dimming, the duty cycle may vary from 0% to 100% to regulate a forward current of LED, and the brightness of the LED can be regulated as a result. Also for example, the frequency of the PWM dimming signal may be greater than about 100 Hz in order to avoid flickering or jittery behavior.

From the dimming curve of shown in FIG. 2, it can be seen that when conduction angle θ of the triac rectifier element is decreasing, the duty cycle of the PWM control signal may also decrease, and the output current $I_{out}$ may decrease slowly. Therefore, when the dimming angle is relatively small (e.g., when the conduction angle is less than about 15%), because the input power is relatively large, the input current may increase rapidly to cause an open loop of the controller. As a result, the input current may not be effectively controlled. Further, since the input current may continue to increase, the input capacitor may not effectively function as a buffer, and vibration can result on the input capacitor.

The following will describe example blend dimming methods and circuits in accordance with embodiments of the present invention. For example, a "blend" dimming approach can include analog dimming as well as digital dimming (e.g., PWM dimming), or only digital dimming in some cases, approaches to drive a light load. For example, a "light load" can include any suitable source of light, such as an LED.

In one embodiment, a blend dimming method for driving a light load can include: (i) converting an external sinusoidal AC power supply to a phase-missing DC voltage signal; (ii) detecting a conduction angle of the phase-missing DC voltage signal to generate a first control signal that represents the conduction angle; (iii) generating an analog dimming signal based on the first control signal; (iv) generating, by a pulse-width modulation (PWM) dimming circuit, a PWM dimming signal based on the analog dimming signal and an output feedback signal of the light load; (v) regulating a brightness of the light load by PWM dimming when the conduction angle is greater than a threshold angle; (vi) regulating the brightness of the light load by the PWM dimming and analog dimming when the conduction angle is less than the threshold angle; and (vii) enabling said PWM dimming circuit to control a power stage circuit to regulate said brightness of said light load when said first control signal is active.

Referring now to FIG. 3, shown is a flow diagram of an example blend dimming method in accordance with embodiments of the present invention. At S301, an external sinusoidal AC power supply can be received and converted to a phase-missing DC voltage signal. For example, triac rectifier circuit and a rectifier bridge may be used to receive the AC power supply, and to generate the phase-missing DC voltage signal.

At S302, a conduction angle of the phase-missing DC voltage signal can be detected to generate a first control signal that represents the conduction angle. At S303, an analog dimming signal can be generated based on the first control signal. At S304, a PWM dimming signal can be generated based on the analog dimming signal and an output feedback signal of a light load (e.g., one or more LEDs). At S305, when a conduction angle of the phase-missing DC voltage signal is greater than a threshold angle, the brightness of the light load can be regulated by PWM dimming.

At S306, when a conduction angle of the phase-missing DC voltage signal is less than the threshold angle, the brightness of the light load can be regulated by PWM dimming and analog dimming. At S307, when the first control signal is inactive, the PWM dimming circuit may be disallowed (e.g., by a gating of its output) from regulating (e.g., via a power stage circuit) a light load. At S308, when the first control signal is active, the PWM dimming circuit can be enabled to regulate the brightness of the light load (e.g., via the power stage circuit).

When the conduction angle of the phase-missing DC voltage signal is greater than the threshold angle, the analog dimming signal can be set to be a predetermined fixed value. Also, when the conduction angle of the phase-missing DC voltage signal is less than the threshold angle, the analog dimming signal can be set to be a variable value. In this example, the threshold value may be about 90°. In other examples, the threshold value may be in a range of from about 75° to about 105° (e.g., from about 85° to about 95°).

In one embodiment, a blend dimming circuit for a power stage circuit can include: (i) a conduction angle detector configured to receive a phase-missing DC voltage signal, and to generate a first control signal that represents a conduction angle of the phase-missing DC voltage signal; (ii) an analog dimming circuit coupled to the conduction angle detector, where the analog dimming circuit is configured to receive the first control signal, and to generate therefrom an analog dimming signal, where the analog dimming signal comprises a predetermined fixed value when the conduction angle is greater than a threshold angle, and where the analog dimming signal comprises a variable value when the conduction angle is less than the threshold angle; and (iii) a PWM dimming circuit coupled to the analog dimming circuit, where the PWM dimming circuit is configured to receive the analog dimming signal, and to generate therefrom a PWM control signal, where the PWM dimming circuit is enabled to regulate a brightness of a light load when the first control signal is active.

Figure 4:
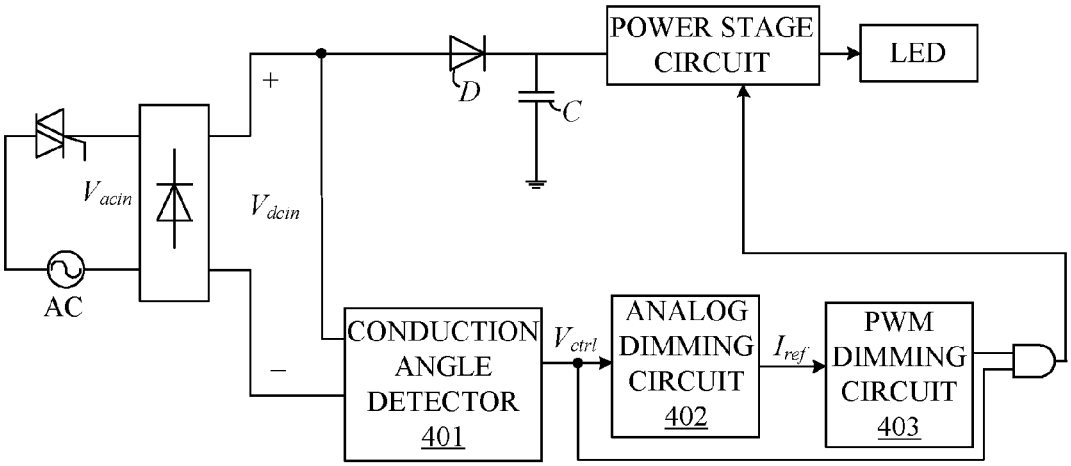
FIG. 4 is a block diagram of a first example blend dimming circuit in accordance with embodiments of the present invention.

Referring now to FIG. 4, shown is a block diagram of a first example blend dimming circuit in accordance with embodiments of the present invention. In this example, an AC power supply can be converted to a phase-missing AC power supply signal $V_{acin}$ through a traic rectifier circuit, and a phase-missing DC voltage signal $V_{dcin}$ can be obtained through a rectifier bridge. The operating state of the power stage circuit can be controlled based on the conduction angle of the phase-missing DC voltage signal, so as to generate an output voltage and an output current at the output terminal of the main circuit to drive a light (e.g., LED) load.

The example blend dimming circuit can include conduction angle detector 401 that can receive the phase-missing DC voltage signal $V_{dcin}$, and generate first control signal $V_{ctrl}$ that represents a conduction angle. Analog dimming circuit 402 can receive first control signal $V_{ctrl}$, and when the conduction angle is greater than a threshold angle, the analog dimming signal $I_{ref}$ output by analog dimming circuit 402 may be a fixed predetermined value. However, when the conduction angle is less than the threshold angle, the analog dimming signal $I_{ref}$ may be variable value.

PWM dimming circuit 403 coupled to analog dimming circuit 402 can receive analog dimming signal $I_{ref}$, and generate a PWM control signal to control the operating state of the power stage circuit. When first control signal $V_{ctrl}$ is inactive, PWM dimming circuit 403 may be disallowed from regulating the LED light load, such as by having its output gated as shown. However, when first control signal $V_{ctrl}$ is active, PWM dimming circuit 403 may be enabled to regulate the brightness of the LED light load via the power stage circuit.

Figure 5:
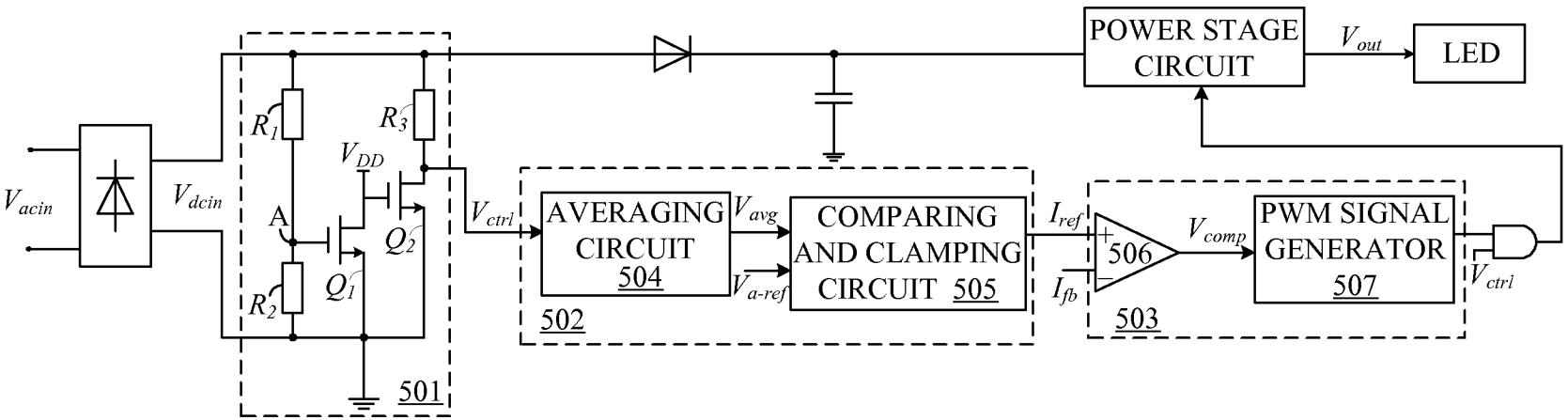
FIG. 5 is a schematic diagram of a second example blend dimming circuit in accordance with embodiments of the present invention.

FIG. 5 shows a schematic diagram of a second example blend dimming circuit in accordance with embodiments of the present invention, and in particular shows example implementations of the example circuits shown in FIG. 4. In this and subsequent diagrams, the same reference numerals but with a '5' in place of a '4' may correspond to the same or similar circuitry of FIG. 4. For example, 501 may correspond to conduction angle generator 401, 502 may correspond to analog dimming circuit 402, and 503 may correspond to PWM dimming circuit 403. Also in this example, the threshold angle may be about 90°.

Conduction angle detector 501 can include resistors $R_1$ and $R_2$, and transistors $Q_1$ and $Q_2$. One terminal of series connected resistors $R_1$ and $R_2$ can connect to ground, and the other terminal can receive phase-missing DC voltage signal $V_{dcin}$. The common junction of resistors $R_1$ and $R_2$ can connect to a control terminal of transistor $Q_1$. A first terminal of transistor $Q_1$ can connect to the control terminal of transistor $Q_2$, and their common junction can connect to an external power supply $V_{DD}$. Second terminals of transistors $Q_1$ and $Q_2$ can connect to ground, and a first terminal of second transistor $Q_2$ can receive phase-missing DC voltage signal $V_{dcin}$ through resistor $R_3$. A voltage on a first terminal of transistor $Q_2$ can be configured as first control signal $V_{ctrl}$.

Figure 6:
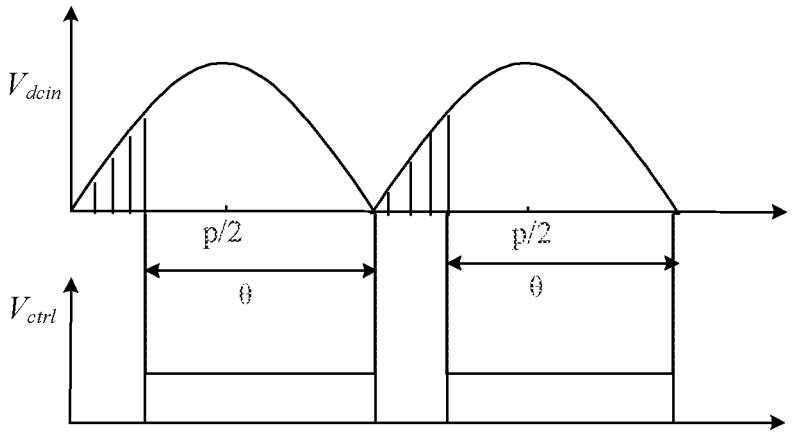
FIG. 6 is an operating waveform diagram of the conduction angle detector shown in FIG. 5.

An example waveform diagram of the conduction angle detector is shown as FIG. 6. Resistors $R_1$ and $R_2$ may be configured to divide phase-missing DC voltage signal $V_{dcin}$, so the voltage at point A can be as shown below in formula (1).

$$V_{dcin}\frac{R_2}{R_1+R_2} \tag{1}$$

$$\frac{R_2}{R_1+R_2} \tag{2}$$

A product of the input voltage corresponding to a start-up phase angle of the conduction angle and formula (2) above may be configured as the conduction threshold value of transistor $Q_1$. At a start time of the conduction angle, transistor $Q_1$ may conduct to pull down a voltage at a control terminal of transistor $Q_2$. As a result, transistor $Q_2$ can be turned off, and first control signal $V_{ctrl}$ may charge to a high level. At a cut-off time of the conduction angle, transistor $Q_1$ may be turned off, and a voltage at the control terminal of transistor $Q_2$ may be configured as external power supply $V_{DD}$, so transistor $Q_2$ may be turned on. Also, at the same time, first control signal $V_{ctrl}$ may be discharged to a low level. It can be seen from FIG. 6 that the pulse width of first control signal $V_{ctrl}$ corresponds to conduction angle θ. In some applications, because first control signal $V_{ctrl}$ is obtained from the phase-missing DC voltage signal $V_{dcin}$ with a similar wave shape, a shaping circuit may be applied to shape first control signal $V_{ctrl}$.

Analog dimming circuit 502 can include averaging circuit 504 and comparing and clamping circuit 505. Averaging circuit 504 may be used to average first control signal $V_{ctrl}$ to obtain an averaging signal $V_{avg}$ that represents conduction angle θ. When conduction angle is about 90°, the corresponding averaging signal may be configured as reference signal $V_{a\text{-}ref}$. Comparing and clamping circuit 505 may be utilized to compare reference signal $V_{a\text{-}ref}$ against averaging signal $V_{avg}$. When averaging signal $V_{avg}$ is greater than reference signal $V_{a\text{-}ref}$ (when conduction angle θ is greater than the threshold angle [e.g., about 90°]), averaging signal $V_{avg}$ may be clamped, and the output analog dimming signal $I_{ref}$ may be a predetermined fixed value. However, when averaging signal $V_{avg}$ is less than reference signal $V_{a\text{-}ref}$ (when conduction angle θ is less than the threshold angle [e.g., about 90°]), the output analog dimming signal $I_{ref}$ may decrease along with averaging signal $V_{avg}$, and thus the brightness of the light load can also decrease.

Figure 7:
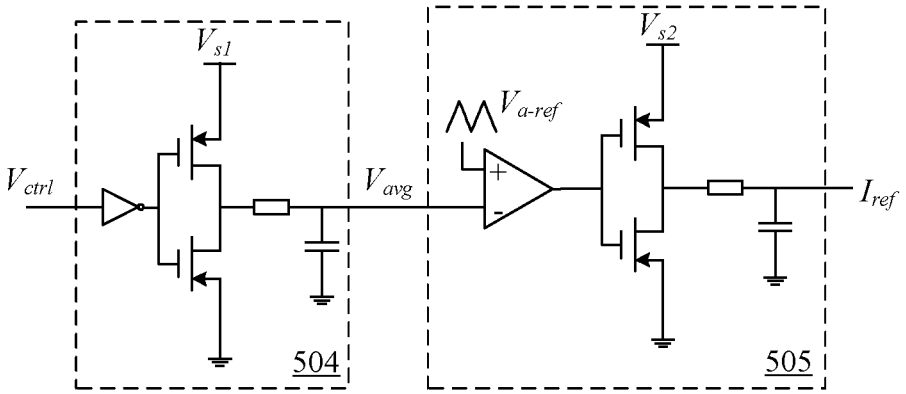
FIG. 7 is a block schematic diagram of the averaging circuit, the comparator, and the clamping circuit shown in FIG. 5.

Referring now to FIG. 7, shown are example implementations of averaging circuit 504, and comparing and clamping circuit 505. First control signal $V_{ctrl}$ can be input after inversion to a common junction of control terminals of an upper transistor and a lower transistor in a push-pull circuit of averaging circuit 504. The push-pull circuit may be coupled between voltage source $V_{s1}$ and ground, and an output of the push-pull circuit can be filtered by an RC filter circuit to obtain averaging signal $V_{avg}$.

Figure 8:
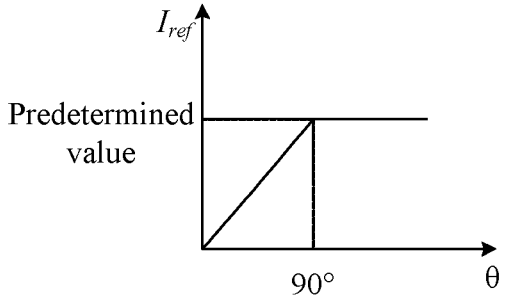
FIG. 8 is a curve diagram showing a relationship of the analog dimming signal and the conduction angle.

Averaging signal $V_{avg}$ can be received by comparing and clamping circuit 505 and be input to the inverting input terminal of a comparator. The non-inverting input terminal of the comparator can receive a triangular wave. For example, the amplitude of the triangular wave can equal reference signal $V_{a\text{-}ref}$. Reference signal $V_{a\text{-}ref}$ and averaging signal $V_{avg}$ can be compared and clamped by the comparator. The output of the comparator can be averaged by another push-pull circuit and filtered by another RC filter circuit to output analog dimming signal $I_{ref}$. FIG. 8 shows an example curve diagram of the variation of the analog dimming signal along with the conduction angle.

In the example shown in FIG. 5, PWM dimming circuit 503 can include comparison circuit 506 and PWM signal generator 507. Comparison circuit 506 can include a comparator, and the non-inverting input terminal of the comparator can receive analog dimming signal $I_{ref}$. The inverting input terminal of the comparator can receive current feedback signal $I_{fb}$ that represents current signal $I_{out}$ of the light (e.g., LED) load. Comparison circuit 506 can compare analog dimming signal $I_{ref}$ against current feedback signal $I_{fb}$ to generate feedback control signal $V_{comp}$.

PWM signal generator 507 can receive feedback control signal $V_{comp}$ to generate a PWM control signal. When first control signal $V_{ctrl}$ is inactive, an output of PWM dimming circuit 503 may be gated by a logic gate in order to disallow PWM dimming circuit 503 from controlling the power stage circuit. However, when first control signal $V_{ctrl}$ is active, PWM dimming circuit 503 may be enabled or otherwise allowed to control the switch of the power stage circuit to regulate the brightness of the light load.

From the example shown in FIG. 5, in the range of the conduction angle when the input voltage is substantially fixed, the blend dimming circuit can employ PWM dimming to determine operation of the power stage based on the first control signal that represents the conduction angle. When the conduction angle is less than the threshold angle, analog dimming may be included along with the PWM dimming to achieve dimming by changing the reference value of the comparison circuit in PWM dimming circuit 503.

Figure 9:
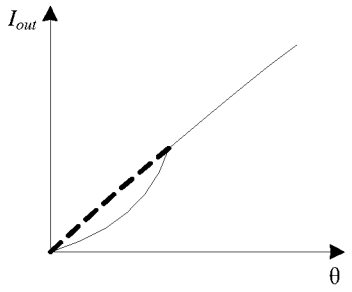
FIG. 9 is a dimming curve diagram of the example blend dimming circuit shown in FIG. 5.

The dimming curve of the example blend dimming circuit shown in FIG. 5 can be seen in the example of FIG. 9. Because blend dimming as described herein is applied, as compared to the PWM dimming curve discussed above, in the start-up range of the conduction angle, output current $I_{out}$ may rise slowly to avoid the problem of input current continuing to rise with strictly PWM dimming.

The above describes various example blend dimming circuits in accordance with embodiments of the present invention. However, those skilled in the art will recognize that other techniques, structures, circuit layout and/or components, can be utilized within the scope of particular embodiments.

The foregoing descriptions of specific embodiments of the present invention have been presented through images and text for purpose of illustration and description of the blend dimming circuitry and methods of operation. They are not intended to be exhaustive or to limit the invention to the precise forms disclosed, and obviously many modifications and variations are possible in light of the above teaching, such as the variable number of the current mirror and the alternatives of the type of the power switch for different applications.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A blend dimming method for driving a light load, the method comprising:

a) converting an external sinusoidal AC power supply to a phase-missing DC voltage signal;

b) detecting a conduction angle of said phase-missing DC voltage signal to generate a first control signal that represents said conduction angle;

c) generating an analog dimming signal based on said first control signal;

d) generating, by a pulse-width modulation (PWM) dimming circuit, a PWM dimming signal based on said analog dimming signal and an output feedback signal of said light load;

e) regulating a brightness of said light load by PWM dimming when said conduction angle is greater than a threshold angle;

f) regulating said brightness of said light load by said PWM dimming and analog dimming when said conduction angle is less than said threshold angle; and g) enabling said PWM dimming circuit to control a power stage circuit to regulate said brightness of said light load when said first control signal is active.

2. The method of claim 1, further comprising:

a) controlling said analog dimming signal as a predetermined fixed value when the conduction angle of said phase-missing DC voltage signal is greater than said threshold angle; and b) controlling said analog dimming signal as a variable value when the conduction angle of said phase-missing DC voltage signal is less than said threshold angle.

3. The method of claim 1, wherein said threshold angle is about 90°.

4. A blend dimming circuit, comprising:

a) a conduction angle detector configured to receive a phase-missing DC voltage signal, and to generate a first control signal that represents a conduction angle of said phase-missing DC voltage signal;

b) an analog dimming circuit coupled to said conduction angle detector, wherein said analog dimming circuit is configured to receive said first control signal, and to generate therefrom an analog dimming signal, wherein said analog dimming signal comprises a predetermined fixed value when said conduction angle is greater than a threshold angle, and wherein said analog dimming signal comprises a variable value when said conduction angle is less than said threshold angle; and c) a pulse-width modulation (PWM) dimming circuit coupled to said analog dimming circuit, wherein said PWM dimming circuit is configured to receive said analog dimming signal, and to generate therefrom a PWM control signal, wherein said PWM dimming circuit is enabled to regulate a brightness of a light load when said first control signal is active.

5. The blend dimming circuit of claim 4, wherein said conduction angle detector comprises:

a) a first transistor having a drain coupled to an external power supply, and a source coupled to ground;

b) a second transistor having a drain coupled to said first control signal, a gate coupled to said external power supply, and a source coupled to ground;

c) a first resistor coupled to said phase-missing DC voltage signal and said gate of said first transistor; and d) a second resistor coupled to said gate of said first transistor and ground.

6. The blend dimming method of claim 4, wherein said analog dimming circuit comprises:

a) an averaging circuit configured to average said first control signal to generate an averaging signal that represents said conduction angle;

b) a comparing and clamping circuit configured to compare said averaging signal against a reference signal, wherein said reference signal equals said averaging signal that is obtained when said conduction angle equals said threshold angle;

c) wherein said comparing and clamping circuit is configured to clamp said averaging signal when said averaging signal is greater than said reference signal, wherein said analog dimming signal output by said comparing and clamping circuit is said predetermined fixed value; and d) said analog dimming signal decreases along with said averaging signal to reduce a brightness of said light load when said averaging signal is less than said reference signal.

7. The blend dimming circuit of claim 4, wherein said PWM dimming circuit comprises:

a) a comparison circuit configured to compare said analog dimming signal against a current signal that represents a current of said light load, and to generate a feedback control signal; and b) a PWM signal generator configured to generate said PWM control signal from said feedback control signal.

8. The blend dimming circuit of claim 4, wherein said threshold angle is about 90°.

9. The blend dimming circuit of claim 4, further comprising a triac rectifier circuit and a rectifier bridge configured to receive an AC power supply, and to generate said phase-missing DC voltage signal.

* * * * *